US009147934B2

(12) United States Patent
Huang et al.

(10) Patent No.: US 9,147,934 B2
(45) Date of Patent: Sep. 29, 2015

(54) ANTENNA STRUCTURE CONFIGURED TO RF SHIELDINGS

(71) Applicant: ARCADYAN TECHNOLOGY CORPORATION, Hsinchu (TW)

(72) Inventors: Chih-Yung Huang, Taichung County (TW); Kuo-Chang Lo, Miaoli County (TW); Jen-Hsiang Fang, Hsinchu (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 115 days.

(21) Appl. No.: 14/187,572

(22) Filed: Feb. 24, 2014

(65) Prior Publication Data

US 2015/0061958 A1 Mar. 5, 2015

(30) Foreign Application Priority Data

Aug. 30, 2013 (TW) ..... 102131312 A

(51) Int. Cl.
*H01Q 1/52* (2006.01)
*H01Q 5/371* (2015.01)

(52) U.S. Cl.
CPC ..... *H01Q 1/526* (2013.01); *H01Q 5/371* (2015.01)

(58) Field of Classification Search
CPC ..... H01Q 5/371; H01Q 1/526
USPC ..... 343/700 MS, 702, 841, 905
See application file for complete search history.

(56) References Cited

U.S. PATENT DOCUMENTS 7,286,090 B1 * 10/2007 Rowell ..... 343/702
7,310,067 B1 * 12/2007 Zhu et al. ..... 343/702
8,059,046 B2 * 11/2011 Nysen ..... 343/725

* cited by examiner

*Primary Examiner* — Khai M Nguyen
(74) *Attorney, Agent, or Firm* — WPAT, PC; Justin King

(57) ABSTRACT

An antenna configured to an RF shielding, comprising: an RF shielding having a feed-in signal open terminal; an antenna coupled to the RF shielding, and the RF shielding and the antenna are integrated, and the antenna comprising: a ground connection terminal coupled to the RF shielding; an impedance matching block coupled to the ground connection terminal; an radiation body coupled to the ground connection terminal, and the radiation body having a feed-in signal terminal corresponding to the feed-in signal open terminal, and expanding forward to the feed-in signal open terminal; and a radiation body expended terminal coupled to the radiation body.

13 Claims, 4 Drawing Sheets

ANTENNA STRUCTURE CONFIGURED TO RF SHIELDINGS

FIELD OF THE INVENTION

The present invention relates to an antenna structure, and more particularly, to an antenna structure configured to RF shieldings.

BACKGROUND OF THE INVENTION

With the increasing popularity of radio communication systems, there are a variety of radio communication devices that are vastly available today, which includes cellular phones, wireless phones, wireless communication PC cards, small radio apparatuses and mobile radio devices. Consequently, the technique for forming an antenna inside the shell of those radio communication devices can be very important, especially for small radio apparatuses. Moreover, for achieving smaller, lighter and thinner radio communication devices, a technology for forming printed antennas on circuitboard had been developed.

In addition, for preventing electro magnetic interfere, it is common to form a shielding on a circuitboard for insulating the circuitboard from being adversely affected by magnetic waves so that the performance of the circuitboard can be ensured and enhanced. However, the shielding can also have an adverse effect upon the radiation intensity of the antenna.

Therefore, it is in need of an innovated and improved antenna structure configured to RF shieldings that can perform at high efficiency without being affected by electro magnetic interfere.

SUMMARY OF THE INVENTION

The primary object of the present invention is to provide an antenna structure configured to RF shieldings, which is an antenna integrating with RF shieldings and RF feed-in signal terminals.

Another object of the invention is to provide an antenna structure configured to RF shieldings, by that the cost for fabricating respective molds for antenna and RF shieldings can be waived, and consequently the additional cost requiring for antenna assembling is saved. Thereby, the application as well as the performance of the antenna structure are not affected.

To achieve the above objects, the present invention provides an antenna structure configured to an RF shielding, comprising: an RF shielding having at least one feed-in signal open terminal; an antenna, coupled to the RF shielding while allowing the same to be integrated with the RF shielding, and the antenna comprising: a ground connection terminal, coupled to the RF shielding; an impedance matching block, coupled to the ground connection terminal; an radiation body, coupled to the impedance matching block, while allowing the radiation body to be configured with a feed-in signal terminal at a position corresponding to the at least one feed-in signal open terminal and expanding forward to the feed-in signal open terminal; and a radiation body expended terminal, coupled to the radiation body; wherein the RF shielding, the ground connection terminal and the impedance matching block are coupled to a system ground.

Preferably, there is an L-shaped connection part disposed at a position between the impedance matching block and the radiation body.

Preferably, there is an included angle formed between the impedance matching block and the L-shaped connection part.

Preferably, the antenna is formed on a circuitboard while allowing the impedance matching block to fit smoothly to the feed-in signal terminal and the same time to be welded to the circuitboard.

Preferably, the radiation body is crooked by an angle into an L-shaped element comprising a first frame and a second frame that are not coplanar disposed while allowing the first frame to couple to the radiation body expended terminal and the L-shaped connection part, and the second frame to couple to the feed-in signal terminal.

Preferably, the impedance matching block, the feed-in signal terminal and the second frame are coplanar disposed.

Preferably, the first frame, the radiation body expended terminal and the L-shaped connection part are coplanar disposed.

Preferably, the RF shielding is formed with one shield surface and lat least four sides, in which each of the at least four sides is formed with a bended portion so as to be form an included angle with the shield surface, and the bended portions are coupled to the system ground, whereby an area with satisfactory RF shielding effect is defined by the enclosure of the shield surface and the bended portions.

Preferably, each of the antennas is disposed about parallel to one of the bended portions while allowing the feed-in signal open terminal to be disposed at the bended portion parallel to the antenna.

Preferably, the amount of the antenna in the antenna structure is at most equal to the amount of sides configured in the RF shielding.

Preferably, the first frame is disposed about parallel to one of the bended portions while allowing the first frame to be formed with a height larger than that of the bended portion parallel to the first frame.

Preferably, the antenna is substantially a planar inverse-F antenna.

Preferably, each of the antenna and the RF shielding is made of a metal, and the metal is selected from the group consisting of: iron and copper.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
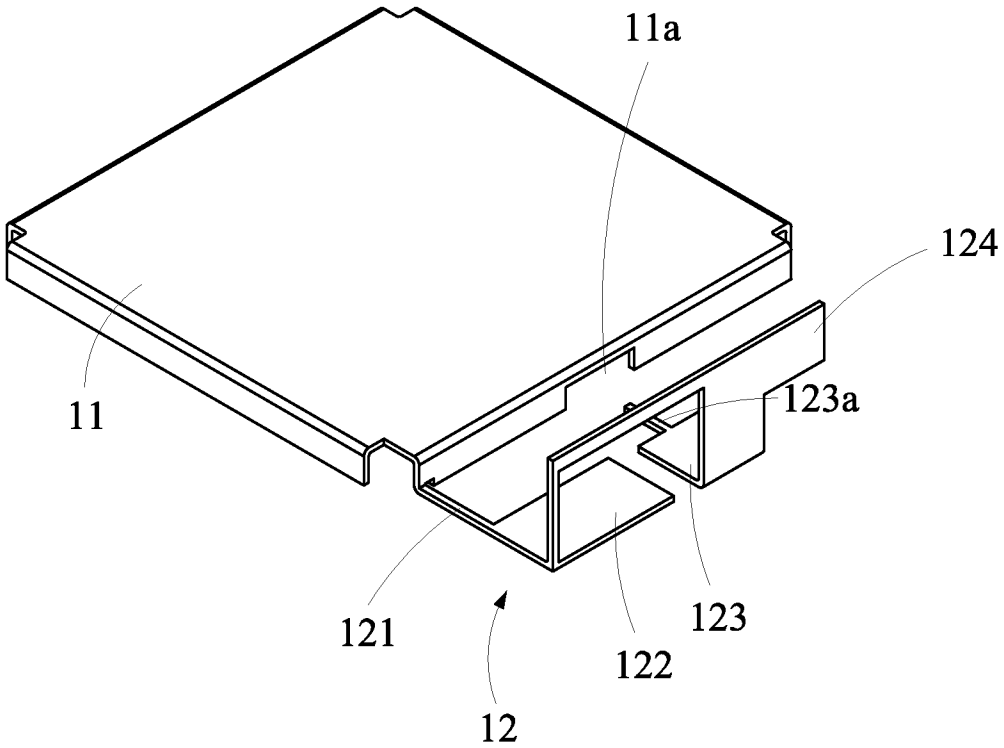
FIG. 1 is a schematic diagram showing an antenna structure configured to RF shieldings according to an embodiment of the present invention.

Please refer to FIG. 1, which is a schematic diagram showing an antenna structure configured to RF shieldings according to an embodiment of the present invention. As shown in FIG. 1, the antenna structure comprises: an RF shielding 11 having at least one feed-in signal open terminal 11*a;* an antenna 12, coupled to the RF shielding 11 while allowing the same to be integrated with the RF shielding 11, and the antenna 12 further comprising: a ground connection terminal 121, coupled to the RF shielding 11; an impedance matching block 122, coupled to the ground connection terminal 121; an radiation body 123, configured with a feed-in signal terminal 123*a* at a position corresponding to the at least one feed-in signal open terminal 11*a* and expanding forward to the feed-in signal open terminal 11*a;* and a radiation body expended terminal 124, coupled to the radiation body 123.

In addition, there is an L-shaped connection part disposed at a position between the impedance matching block 122 and the radiation body 123. In an embodiment of the invention, the antenna 12 can be a planar inverse-F antenna, and each of the antenna 12 and the RF shielding 11 is made of a metal, and the metal is selected from the group consisting of: iron and copper.

Figure 2:
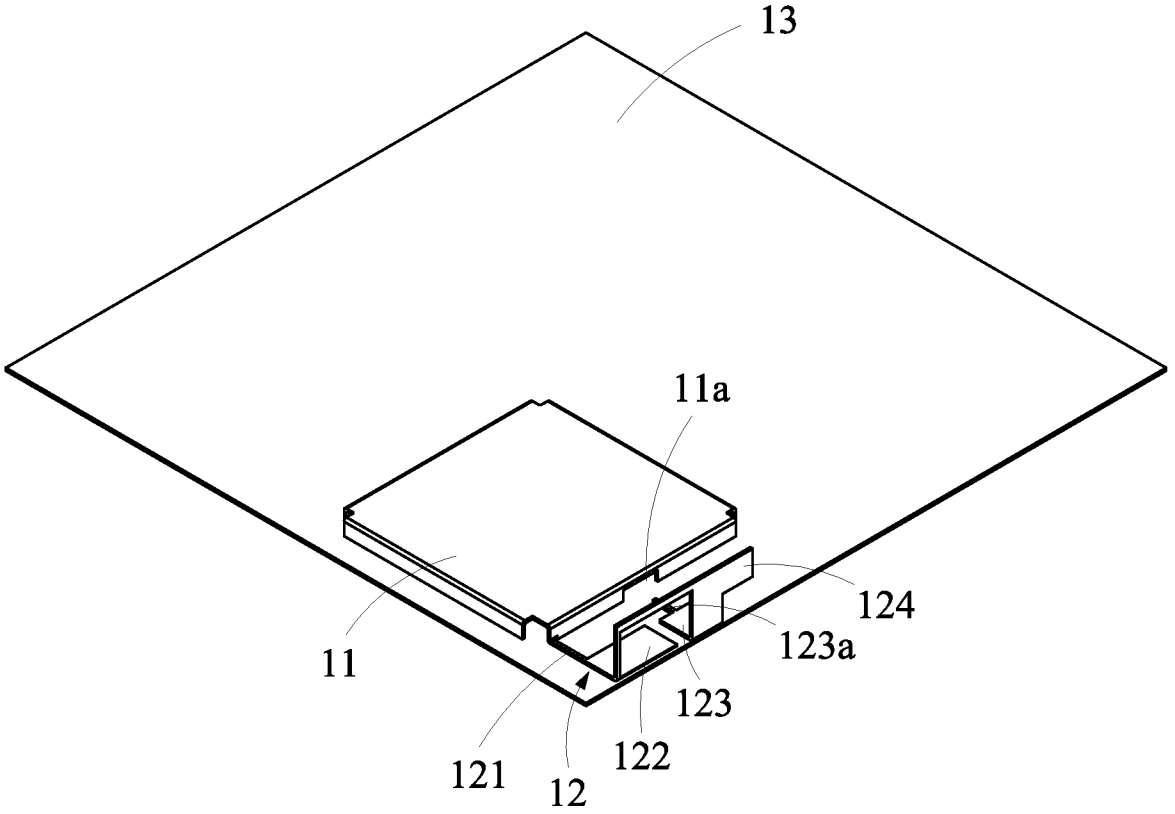
FIG. 2 is a schematic diagram showing an antenna structure of FIG. 2 that is being disposed on a circuitboard.

Please refer to FIG. 2, which is a schematic diagram showing an antenna structure of FIG. 2 that is being disposed on a circuitboard. In FIG. 2, the antenna is formed on a circuitboard 13 while allowing the impedance matching block 122 and the radiation body 123 to fit smoothly to the circuitboard 13 and the same time to be welded to the circuitboard 13. Moreover, the radiation body 123 is crooked by an angle θ into an L-shaped element, and the antenna structure is disposed at a corner of the circuitboard 13 while being coupled to the periphery of the circuitboard 13, whereas the circuitboard 13 can be a printed circuitboard (PCB).

Figure 3:
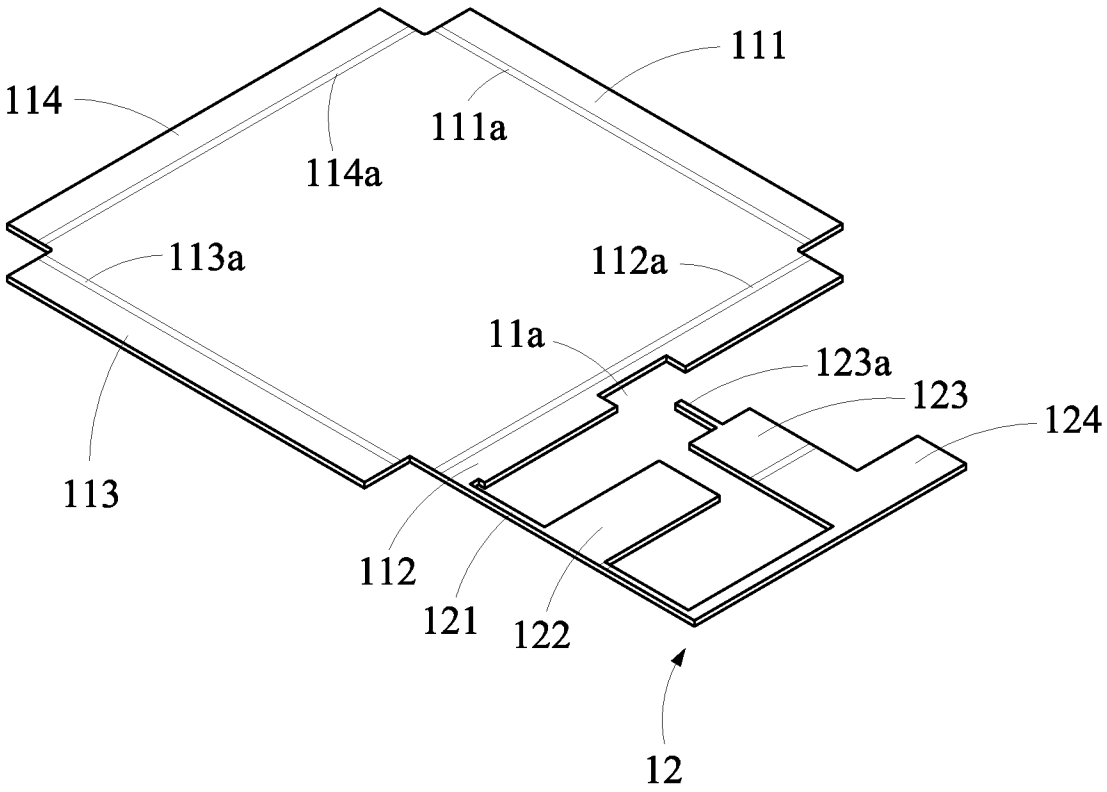
FIG. 3 is an exploded view of an antenna structure configured to RF shieldings according to an embodiment of the present invention.

Please refer to FIG. 3, which is an exploded view of an antenna structure configured to RF shieldings according to an embodiment of the present invention. As shown in FIG. 3, the RF shielding 11 in the antenna structure is composed of a plurality of bended portions, e.g. the four bended portions 111, 112, 113, and 114 shown in the embodiment of FIG. 3. In FIG. 3, the four bended portions are configured respectively with four bended lines 111*a,* 112*a,* 113*a* and 114*a,* by that the bended portions 111, 112, 113, and 114 can be bended before being welded to the circuitboard 13.

Figure 4:
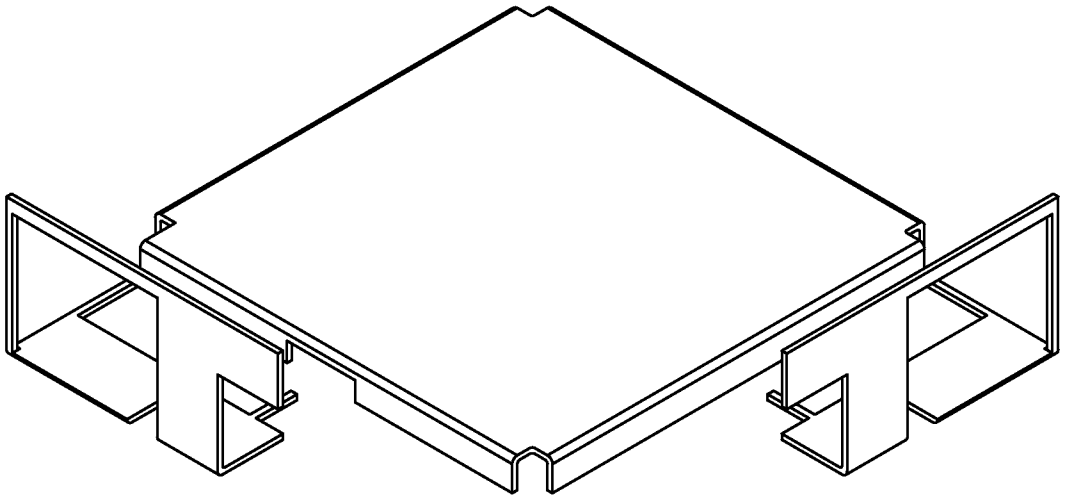
FIG. 4 is a schematic diagram showing an antenna structure with multiple antennas that is configured to RF shielding according to the present invention.

Please refer to FIG. 4, which is a schematic diagram showing an antenna structure with multiple antennas that is configured to RF shielding according to the present invention. It is noted that for improving antenna performance, there can be more than one antenna being mounted to each and any one of the four sides of the RF shielding 11.

In fact, since the RF shielding 11 and the antennas 12 in the present invention are integrally formed, only one mold is required for the fabrication of the structure so that the cost for fabricating respective molds for antenna and RF shieldings can be waived, and consequently the additional cost requiring for antenna assembling is saved. Thereby, the application as well as the performance of the antenna structure are not affected. Moreover, since the signal feed-in terminal is substantially a 50 Ω resistor soldered directly on the circuitboard 13 that there will be no conventional cost of cable feed-in, nor did it required any special design for signal feed-in.

To sum up, the present invention provides a planar inverse-F antenna (PIFA) configured to an RF shielding, by that the PIFA and the RF shielding are integrally formed while simultaneously integrating an RF signal feed-in means into the RF shielding, and thus the cost for fabricating respective molds for the antenna and the RF shieldings can be reduced, while the characteristics as well as the performance of the antenna itself are not affected.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. An antenna structure configured to an RF shielding, comprising:

an RF shielding having at least one feed-in signal open terminal;

an antenna, coupled to the RF shielding while allowing the same to be integrated with the RF shielding, and the antenna comprising:

a ground connection terminal, coupled to the RF shielding;

an impedance matching block, coupled to the ground connection terminal;

an radiation body, coupled to the impedance matching block, while allowing the radiation body to be configured with a feed-in signal terminal at a position corresponding to the at least one feed-in signal open terminal and expanding forward to the feed-in signal open terminal; and a radiation body expended terminal, coupled to the radiation body.

2. The antenna structure of claim 1, wherein there is an L-shaped connection part disposed at a position between the impedance matching block and the radiation body.

3. The antenna structure of claim 2, wherein there is an included angle formed between the impedance matching block and the L-shaped connection part.

4. The antenna structure of claim 1, wherein the antenna is formed on a circuitboard while allowing the impedance matching block and the ground connection terminal to fit smoothly to the feed-in signal terminal and the same time to be welded to the circuitboard.

5. The antenna structure of claim 2, wherein the radiation body is crooked by an angle into an L-shaped element comprising a first frame and a second frame that are not coplanar disposed while allowing the first frame to couple to the radiation body expended terminal and the L-shaped connection part, and the second frame to couple to the feed-in signal terminal.

6. The antenna structure of claim 4, wherein the antenna is disposed at a corner of the circuitboard while being coupled to the periphery of the circuitboard.

7. The antenna structure of claim 1, wherein there are at least two antennas being included in the antenna structure.

8. The antenna structure of claim 1, wherein the RF shielding is formed with one shield surface and lat least four sides, and each of the at least four sides is formed with a bended portion so as to be form an included angle with the shield surface, while the bended portions are coupled to the system ground, whereby an area with satisfactory RF shielding effect is defined by the enclosure of the shield surface and the bended portions.

9. The antenna structure of claim 8, wherein each of the antennas is disposed about parallel to one of the bended portions while allowing the feed-in signal open terminal to be disposed at the bended portion parallel to the antenna.

10. The antenna structure of claim 8, wherein the amount of the antenna in the antenna structure is at most equal to the amount of sides configured in the RF shielding.

11. The antenna structure of claim 8, wherein the first frame is disposed about parallel to one of the bended portions while allowing the first frame to be formed with a height larger than that of the bended portion parallel to the first frame.

12. The antenna structure of claim 1, the antenna is substantially a planar inverse-F antenna.

13. The antenna structure of claim 1, wherein each of the antenna and the RF shielding is made of a metal, and the metal is selected from the group consisting of: iron and copper.

* * * * *